US007543591B1

(12) United States Patent
Munsil

(10) Patent No.: US 7,543,591 B1
(45) Date of Patent: Jun. 9, 2009

(54) PRE-CHARGED FOLDED COMPACTS FOR COLORING HAIR

(76) Inventor: Karen Munsil, 5661 S. Pinehurst Ave., Springfield, MO (US) 65801

( * ) Notice: Subject to any disclaimer, the term of this patent is extended or adjusted under 35 U.S.C. 154(b) by 223 days.

(21) Appl. No.: 11/708,239

(22) Filed: Feb. 20, 2007

Related U.S. Application Data

(60) Provisional application No. 60/775,035, filed on Feb. 21, 2006, provisional application No. 60/808,401, filed on May 25, 2006.

(51) Int. Cl.
*A45D 19/18* (2006.01)
*A45D 24/22* (2006.01)

(52) U.S. Cl. ..... 132/270; 132/112

(58) Field of Classification Search ..... 132/270, 132/208, 212, 112; 8/408
See application file for complete search history.

(56) References Cited

U.S. PATENT DOCUMENTS

| | | | | |
|---|---|---|---|---|
| 4,503,870 | A * | 3/1985 | Peterson | 132/270 |
| 4,576,826 | A | 3/1986 | Liu et al. | 426/289 |
| 4,690,206 | A | 9/1987 | Bein | 165/81 |
| 4,942,893 | A * | 7/1990 | Trottier | 132/270 |
| 4,995,217 | A | 2/1991 | Francis, Jr. | 53/410 |
| 5,287,864 | A | 2/1994 | Gallo | 132/208 |
| 5,349,970 | A | 9/1994 | Razzouq | 132/208 |
| RE34,944 | E | 5/1995 | Yamane | 428/335 |
| 5,664,590 | A | 9/1997 | Plateroti et al. | 132/270 |
| 5,860,431 | A | 1/1999 | Abercrombie et al. | 132/208 |
| 5,931,168 | A | 8/1999 | Abercrombie et al. | 132/208 |
| 6,237,608 | B1 | 5/2001 | Kari | 132/208 |
| 6,811,055 | B2 | 11/2004 | Polesuk | 221/45 |
| 6,863,076 | B2 | 3/2005 | Russell | 132/222 |
| 6,968,849 | B2 | 11/2005 | Vena et al. | 132/208 |
| 2003/0135937 | A1 * | 7/2003 | Barrass et al. | 8/408 |
| 2005/0028835 | A1 * | 2/2005 | Husband et al. | 132/270 |

* cited by examiner

*Primary Examiner*—Robyn Doan
(74) *Attorney, Agent, or Firm*—Jonathan A. Bay

(57) ABSTRACT

A folding case is provided for transferring hair-coloring chemicals to a selected bundle of hair. The folding case has a pair of opposing shallow compartments that are adapted for containing a pre-charge of color-base hair-coloring chemicals in one compartment and a pre-charge of activator therefor in the other compartment. Peel-away films are provided to cover and seal each compartment in order to seal in the respective pre-charges therein not only to keep the respective pre-charges separate and apart from each other and avoid premature interaction therebetween but also to keep each pre-charge fresh and preserved during transit through a supply chain from a place of manufacture or production to a remote later-time of and place for end-utilization.

11 Claims, 7 Drawing Sheets

PRE-CHARGED FOLDED COMPACTS FOR COLORING HAIR

CROSS-REFERENCE TO PROVISIONAL APPLICATION(S)

This application claims the benefit of U.S. Provisional Application No. 60/808,401, filed May 25, 2006, and U.S. Provisional Application No. 60/775,035, filed Feb. 21, 2006. All the foregoing patent disclosures are fully incorporated herein by reference.

BACKGROUND AND SUMMARY OF THE INVENTION

The invention relates to apparatus and methods for coloring hair and, more particularly, to apparatus and methods in comparable in general ways but distinguished in particular other ways from the prior art way of salon-style foiling hair, one non-limiting example of which comprises the disclosure of U.S. Pat. No. 5,349,970—Razzouq, the disclosure of which is incorporated herein by reference.

Highlights have been and are popular not only historically with but nowadays as sought-after as ever by consumers such as salon customers. Highlights involve bleaching (or otherwise coloring) select strands of hair to achieve a color that is different (usually lighter, and/or disguising graying) from that of the consumer's baseline hair shade(s). This in turn provides unique effects such as a sun-kissed look on an individual with dark blonde hair, or possibly lighter brown streaks on a darker-haired individual, and so on.

In beauty salons, customers wanting highlights (or lowlights) usually have it done by a foil process. The conventional foil process is not only costly but also time-consuming. For the beautician, the foil process is laborious. Generally, the entire (foil) process extends over two to three hours. Typically many small pieces of metal (eg., aluminum) foil—folded or rolled/crumpled in slender sleeves—are distributed through the customer's hair based upon the judgment of the beautician.

Briefly, the foundation of the foil process begins with the beautician mixing the chemicals which combine to yield the coloring compound. That is, the coloring compound is a two component admixture of two chemicals, namely, the color base and then the activator. The color base is typically provided in paste, gel or thick liquid forms. The activator typically contains hydrogen peroxide. Hence, in order to color hair, the color base must be mixed with the activator.

The beautician might begin a foil process by selecting a color or colors from a pallette of the on-hand supply of color bases. If the color base is in paste form it might be dispensed from a squeeze tube as toothpaste. Alternatively, if the color chemical is more nearly a gel or liquid it might be contained in a small (plastic or glass) container from which it is poured or shaken out. Also, once a brand-new squeeze tube or container of color base is freshly cracked open, it typically has a relatively short shelf-life of a week or so if not days.

Continuing on, the beautician dispenses an amount of color base into a mixing bowl, adds another amount of the activator, and stirs the two together thoroughly. At this stage, the beautician can turn her or his attention to the customer. The beautician "weaves" the customer's scalp or, that is, separates select strands hair into numerous distinct "chunks," or bundles, tufts &c. A rectangular patch of aluminum foil is pulled from a dispenser. The beautician gives the foil patch a folded margin just along the edge that will be disposed closest to the customer's scalp. Then the beautician creases the patch in half to form a V-shaped trough of two leafs meeting at a middle fold line. Next the beautician paints, with a modified paint brush, the admixture of color base and activator into the depth of the fold of the V-shaped trough. The beautician lays a bundle of the customer's hair strands in the foil trough, perhaps paints the hair bundle as well, and then folds closed or otherwise rolls/crumples the open leafs around the hair bundle in slender sleeves. To finish, the beautician stuffs as best she or he can a cotton barrier between the scalp and foil tube to absorb in any bleed of the color compound out the end, lest the roots of nearby hairs be bleached out (or otherwise colored) too much. Thus far, the beautician has completed the job for one bundle. The beautician repeats—over and over again—the above steps for all the numerous other selected hair bundles.

When all the foils are in place, the customer is seated on a chair with her (or his) head crowned by the hood of a hooded-hair dryer. After an appropriate period of time, the customer is retrieved from the chair dryer, the foils are removed and the hair is rinsed well in order to flush out the last remnants of the color compound.

Needless to say, the beautician's placement of the foil wraps is a time consuming, labor intensive task that also requires judgment and skill, and when that is considered along with the time required for the actual bleaching (or otherwise coloring) operation, the entire supervision over the process becomes quite lengthy and difficult.

There are other ways of highlighting one's hair. Many economical do-it-yourself (or home-style) kits are sold retail for consumers to highlight their own hair in the privacy of their own home and by processes which involve only a fraction of the fuss as the foregoing salon-style foil process. Nevertheless, the demand for the salon-style foil process persists because, simply, it obtains the best results. And when it comes to one's own hair, factors such as image and confidence tend to push consumers toward accepting the cost and time drawbacks of the salon-style foil process in order to minimize the risk of inconsistent home-style results as well as maximize the outcome gotten best by skilled beautician professionals. This remains true to date even though, in prestige beauty salons, the salon-style foil process can cost several hundred dollars or more.

What is needed are improvements over the shortcomings of the prior art, ones which among other things speed up the salon-style foil process for the sake of the beauticians, so that more of their skill and energy is spent on selecting colors from the available pallette and weaving the customer's hair mass into the selected bundles and less on the mundane tasks of folding and painting foil patches as well as applying the cotton bleed-barriers.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
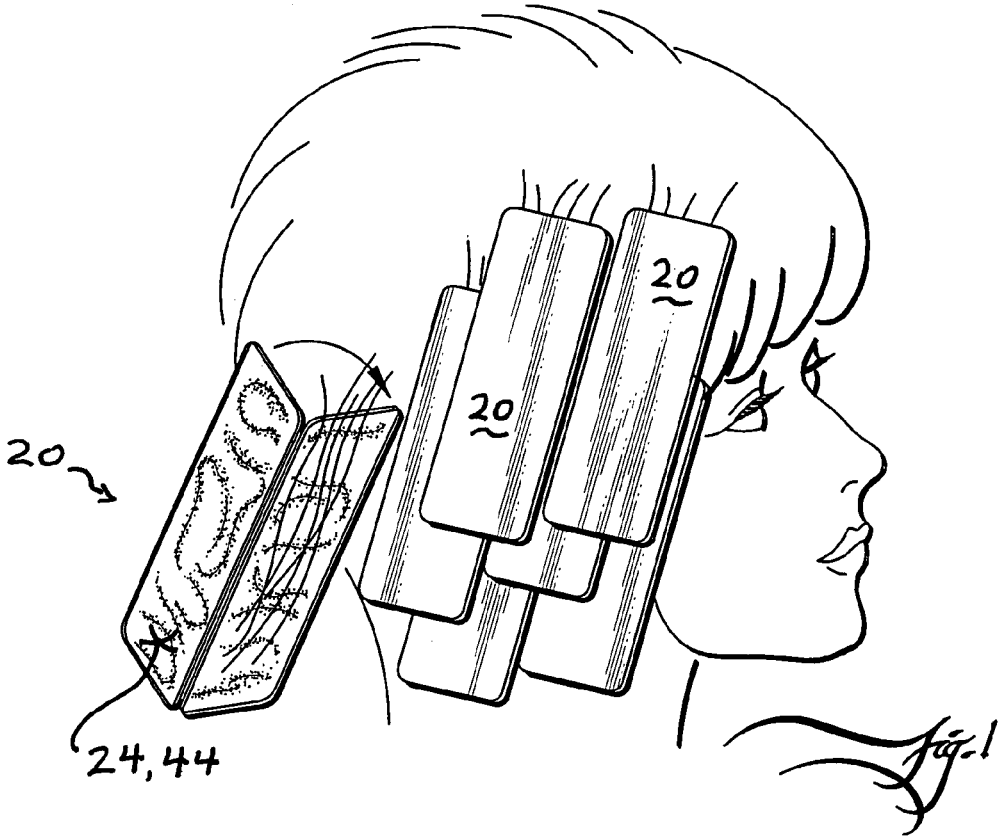
FIG. 1 is a perspective view of a salon-style hair-coloring process in accordance with the invention utilizing pre-charged folded compacts in accordance with the invention.
Figure 2:
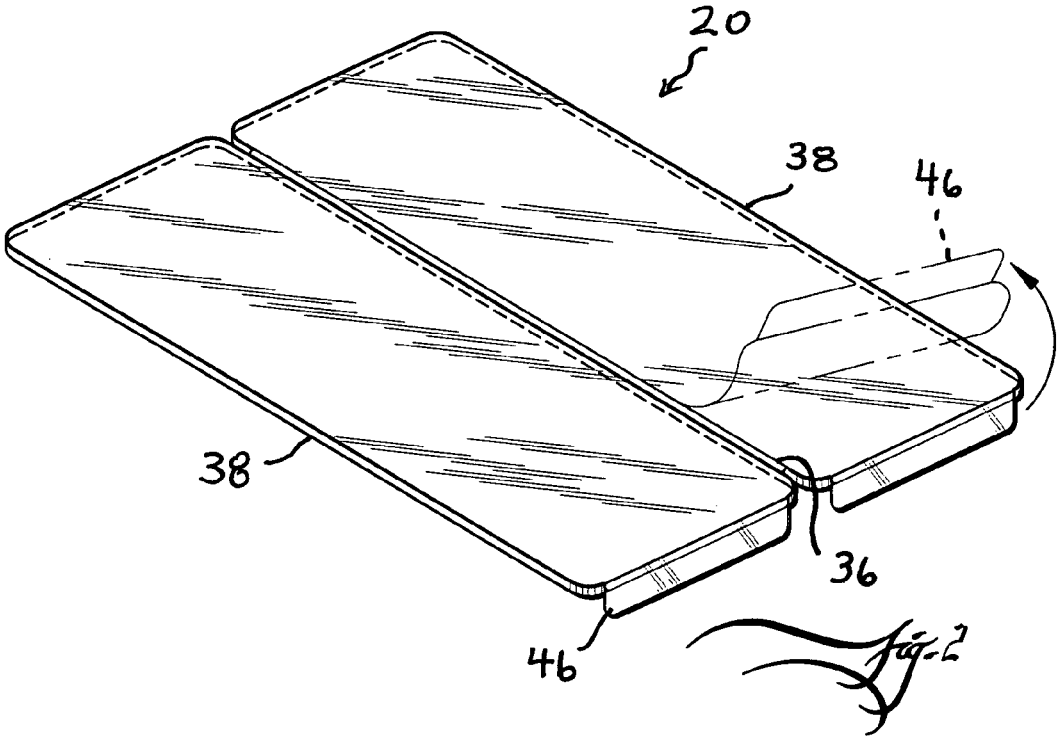
FIG. 2 is an enlarged scale perspective view of a single pre-charged folded compact of FIG. 1, shown spread out flat, wherein a peel-away covering film or barrier is shown in broken lines in a partially peeled back state.
Figure 3:
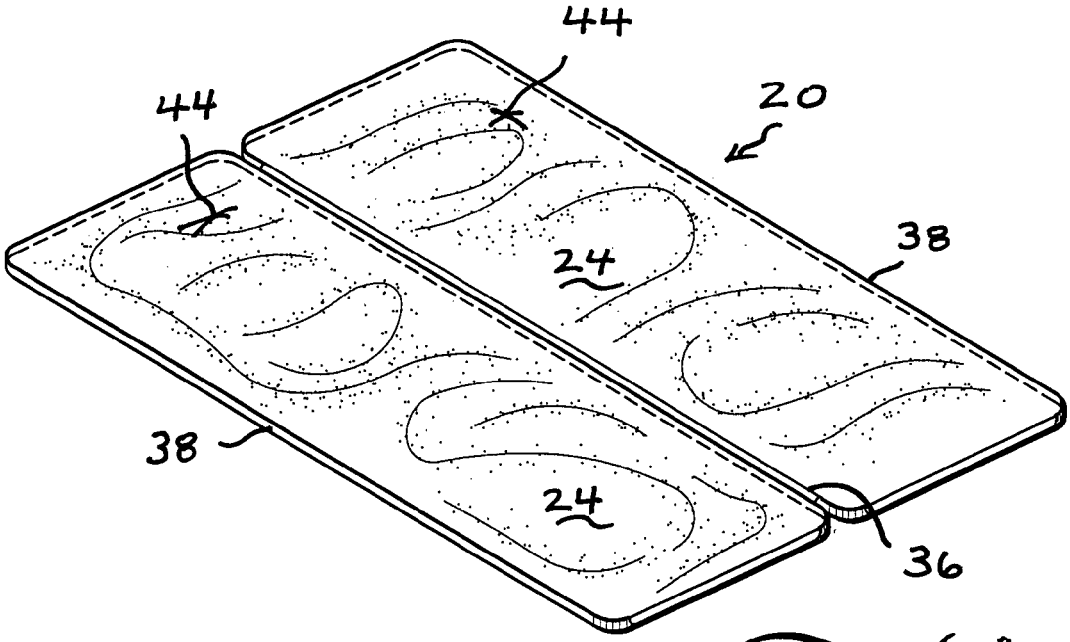
FIG. 3 is a perspective view comparable to FIG. 2 except the peel-away covering films on both leafs of the compact have been peeled off the compact.
Figure 4:
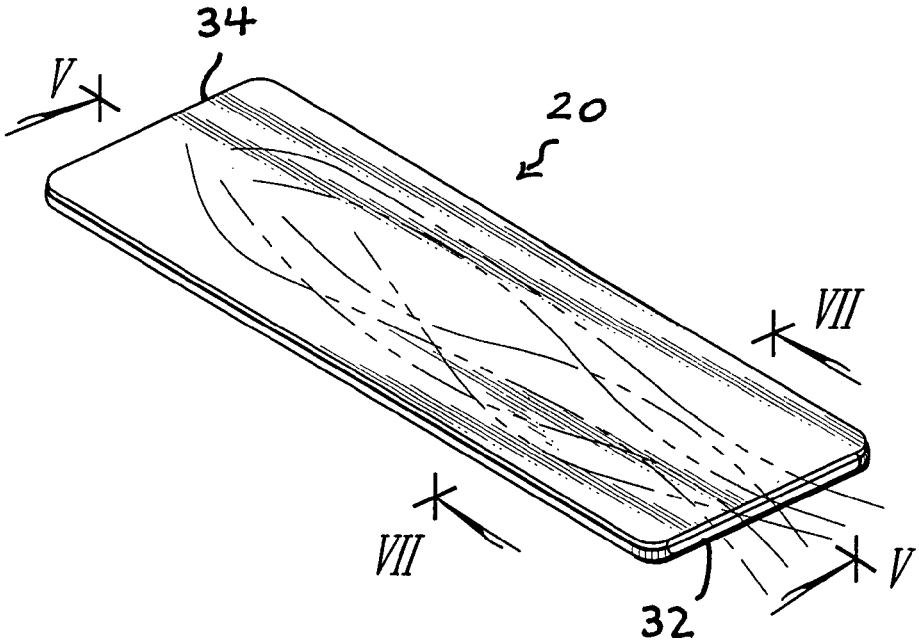
FIG. 4 is a perspective view comparable to FIG. 3 except showing the compact folded shut on a bundle of hair, as shown in several instances by FIG. 1.

FIG. 1 shows a salon-style hair-coloring process in accordance with the invention, utilizing pre-charged folded compacts 20 in accordance with the invention, one of which is better shown in FIGS. 2 through 4. It is preferred if such compacts 20 are produced as thin plastic products comprised of two shallow rectangular compartments 24 (or halves or else leafs) hinged along one elongated edge 36. Each rectangular compartment 34 comprises a rectangular web 28 surrounded by four low peripheral rims or walls along the four edges 32, 34, 36 and 38 thereof. That is, the rectangular web 28 (or flat span) extends not only between a spaced scalp-ward and tail edge 32 and 34 but also between spaced elongated edges 36 and 38. One of the elongated edges comprises a hinge edge 36 as the other elongated edge comprises a closure or latching edge 38. Each of the scalp-ward, tail and elongated edges 32, 34, 36 and 38 forms a low peripheral rim or wall. The two compartments 24 are joined by a thin ribbon 42 of connecting material that spans between the two counterpart hinge edges 36 and thereby forms a hinge joint for the inventive compact 20.

It is an aspect of the invention that the inventive compact 20 is supplied to hair salons pre-charged with the activator and color-base hair-coloring chemicals 44. That is, the color base is pre-charged in one of the compartments 24, the activator is pre-charged in the other of the compartments 24, and the two chemicals 44 are kept preserved and separated from the time of manufacture, all during transit through the supply chain, until the moment of use at a hair-styling salon (or wherever else use environment) at which time the separation therebetween is removed and the two chemicals 44 are allowed to mix.

Again, to put it differently, the compact 20 comprises one compartment providing storage of one chemical 44, for example the activator. The compact 20 furthermore comprises a counterpart compartment for the storage of the other chemical 44, for example the color base. From the time of being launched from manufacture and during transit through the supply chain, the two chemicals 44 are sealed in each's respective compartment 24 not only to prevent premature mixing therebetween but also to prevent spoliation, and preserve the freshness of each chemical 44 until unsealed.

It is another aspect of the invention that the inventive compact 20 hereof (and modifications thereof recognized by persons ordinarily skilled in the art) functions as container for distributing a widely diverse array of contents. More particularly, it is an aspect of the invention that the inventive compact 20 be distributed in mass with widely diverse admixtures of hair-coloring chemicals 44 to provide hair colors and/or tints across the spectrum. That way, in a beauty salon, the beautician can select this or that compact 20 as well as from any and all others in numerous different hair-color shades or tints to skillfully and artistically create an overall effect most pleasing to the customer.

To review the prior art way of coloring, a beautician ordinarily mixes the color base and activator upon the occasion of a customer's appointment. While there is no actual constraint on how many color bases a beautician might select to mix small dollops thereof in separate bowls with activator (and thereby produce a diverse pallette of colors for any given customer), there are indeed practical constraints. That is, a beautician is not likely to mix up a dozen different bowls of different color bases for an ordinary customer because of not only the time in labor to do so but also the limits on the customer's pocketbook to afford such extensive exactness.

In contrast, with the inventive compact 20, the beautician can select compacts 20 from this and that shade or tone and have at hand a rainbow of shades or tones to choose from. There is no disincentive to color only one hair bundle out of a hundred with just one specific shade or tone. Conversely, the prior art way of doing things did provide such a disincentive because the effort mixing activator and color base in a bowl to color just one hair bundle in a hundred is hardly worthwhile from both the perspective of beautician and customer.

FIGS. 2 through 4 show a single pre-charged folded compact 20 in accordance with the invention. Preferably the compact 20 is produced of a suitable plastic material, one which is economical in that the compact 20 is used-once and then discarded or recycled. Again, the compact 20 comprises a first shallow rectangular compartment 24 and a second shallow rectangular compartment 24 as previously described. FIG. 2 shows the compact 20 spread out flat. Each compartment 24 is separately sealed with a peel-away covering film 46 or barrier in order to seal in a pre-charge of chemicals 44 in each compartment 24. Generally, one compartment 24 is pre-charged with a color base as the other compartment 24 is pre-charged with an activator. The peel-away covering film 46 keeps each chemical 44 separate from the other as well as fresh and preserved on its own merits until the time of use. FIG. 2 also shows in broken lines the right side (eg., right in the view) peel-away covering film 46 in the process of being peeled off.

In use, the beautician would peel off the peel-away covering film 46 at about the time the beautician would very soon afterward apply the compact 20 to a bundle of the customers hair. Accordingly, FIG. 3 shows the compact 20 with both peel-away covering films 46 peeled off. Returning to FIG. 1, it shows the leftmost (eg., left in the view) compact 20 being closed upon a bundle of the customers hair. Again, one compartment 24 of the plastic compact 20 is pre-charged with the color base that determines the coloring-effect given to the customer's hair. The other compartment 24 of the compact 20 is pre-charged with the activator. The beautician selects a bundle or grab of the customers hair to be shut inside the closed compact 20. Such a bundle or grab of hair is placed between the two compartments 24 and the compact 20 is shut. Upon closing of the compact 20, the chemicals 44 in the two compartments 24 interact with each other, allowing the color base and the activator to mix and thus color the hair. As shown, several of these plastic compacts 20 are applied to different parts of the customer's hair as chosen by the beautician. Time is saved using this pre-charged folded compact 20 in accordance with the invention because the activator and color base are loaded-in-advance (or, "pre-charged") in the rectangular compartments 24 of the compact 20 and thus there is no need to manually mix the two chemicals 44 beforehand or while the customer is waiting. FIG. 4 shows the compact 20 folded shut on a bundle of hair, as shown in numerous other repeat instances by FIG. 1.

Figure 5:
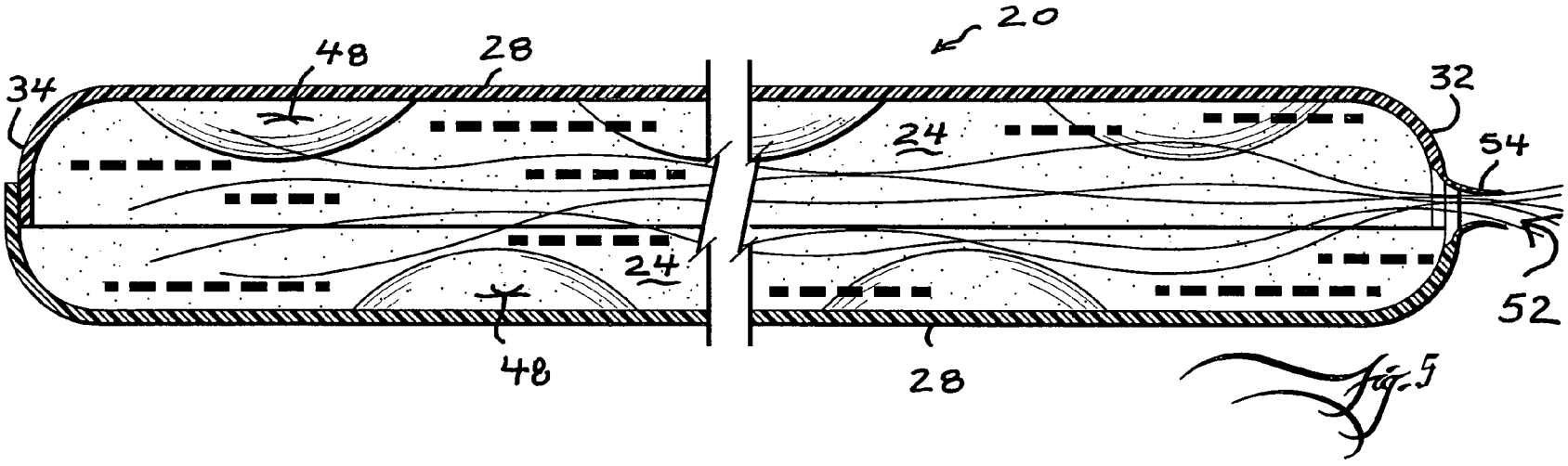
FIG. 5 is an enlarged scale sectional view taken along the line of V-V in FIG. 4, with central portions broken away.
Figure 6:
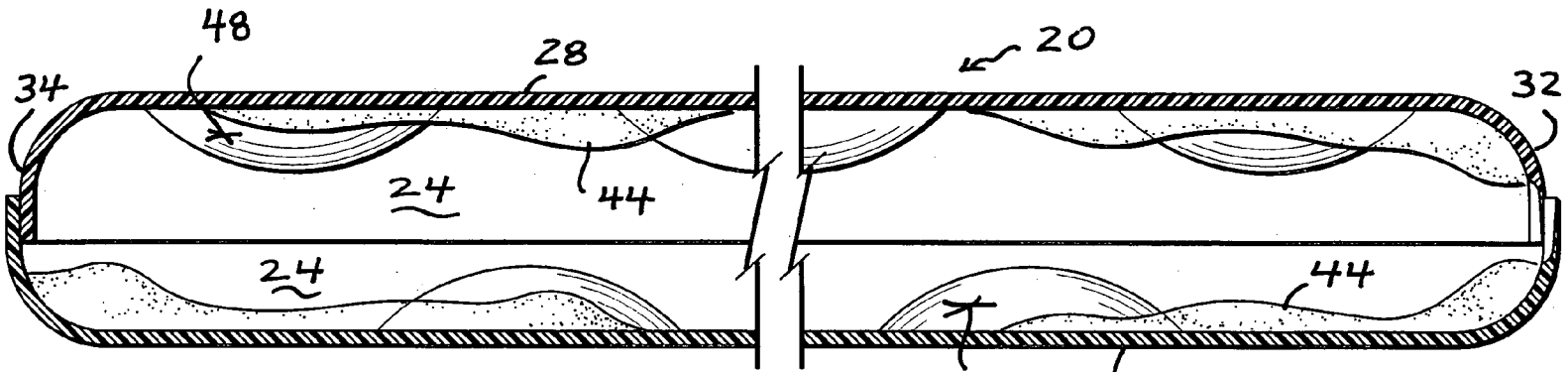
FIG. 6 is a sectional view comparable to FIG. 5 except showing the compact after having been stripped off the hair bundle with excess compound remaining in the compact.

FIG. 5 is a sectional view taken along the line of V-V in FIG. 4 or, in other words, a sectional view taken from the scalp-ward edges 32 through the tail edges 34. The rectangular webs 28 of each compartment 24 are formed with a pattern of protrusions 48 arranged to promote mixing of the chemicals 44 once the peel-away covering film 46 is removed and compact 20 is shut. This pattern of protrusions 48 promotes the squishing of chemical 44 from one compartment 24 into the other compartment 24 upon the closing of the compact 20. FIG. 5 also shows that the scalp-ward edges 32 of the compact 20 form a slot 52 protected by wiper-formations 54. The customer's bundle of hair that is shut closed in the compact 20 is allowed to extend out this slot 52. It is doubtful that in the absence of such slot 52 the scalp-ward edges 32 would cut or otherwise sever the customer's hair. Nevertheless, ample clearance is afforded the customer's hair by such a slot 52 at the scalp-ward edges 32. The wiper-formations 54 on each compartment 24 of the slot 52 operate like resilient seals. The wiper-formations 54 function to contain the chemicals 44 inside the shut compact 20 during the extended time that is given to the chemicals 44 to treat or react with the hair. That way, this eliminates or minimizes the likelihood that chemicals will leak and thereafter undesirably react with or treat hair strands that are not selected by the beautician for the bundle. Also, as FIG. 6 shows, at the end of the treatment time the beautician merely pulls off the shut compact 20. That is, the beautician does not open the compact 20 to remove it. Instead, the beautician withdraws the compact 20 by pulling it such that the customer's bundle of hair slides out the wiper-protected slot 52 (eg., as protected by wipers 54) in the scalp-ward edges 32.

In contrast, the tail edges 34 overlap and thereby form a tighter seal, and one which is not particularly adapted for accommodating the passage of hair.

FIG. 6 shows the still shut compact 20 after having been stripped off the selected bundle of the customer's hair. The wiper-formations 54 have bent back to a closed position. A moderate amount of excess compounded chemical 44 remains. The compact 20 is either disposed of or else better still recycled for its plastic material.

Figure 7:
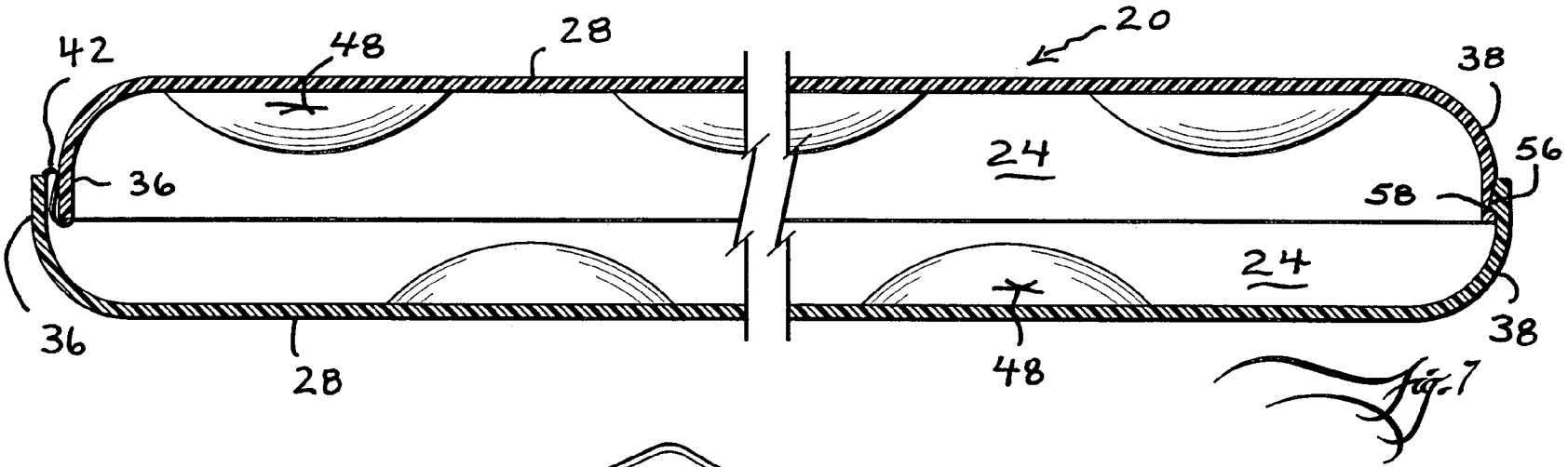
FIG. 7 is an enlarged scale sectional view taken along the line of VII-VII in FIG. 4, wherein all the compound is removed from view for convenience of clarity's sake.

FIG. 7 is a sectional view transverse to FIGS. 5 and 6 except all the chemicals 44 are removed from view for convenience of clarity's sake. The left periphery (eg., left given the vantage point of the view) comprises the hinge edges 36 and interconnecting ribbon 42 therefor. Conversely, the other (eg., right) periphery comprises the latching edges 38. When shut, the latching edges 38 of the two compartments 24 of the shut compact 20 comprise counterpart barb and catch formations 56 and 58 respectively so that the compact 20 snaps shut and stays (relatively) locked upon closure.

Figure 8:
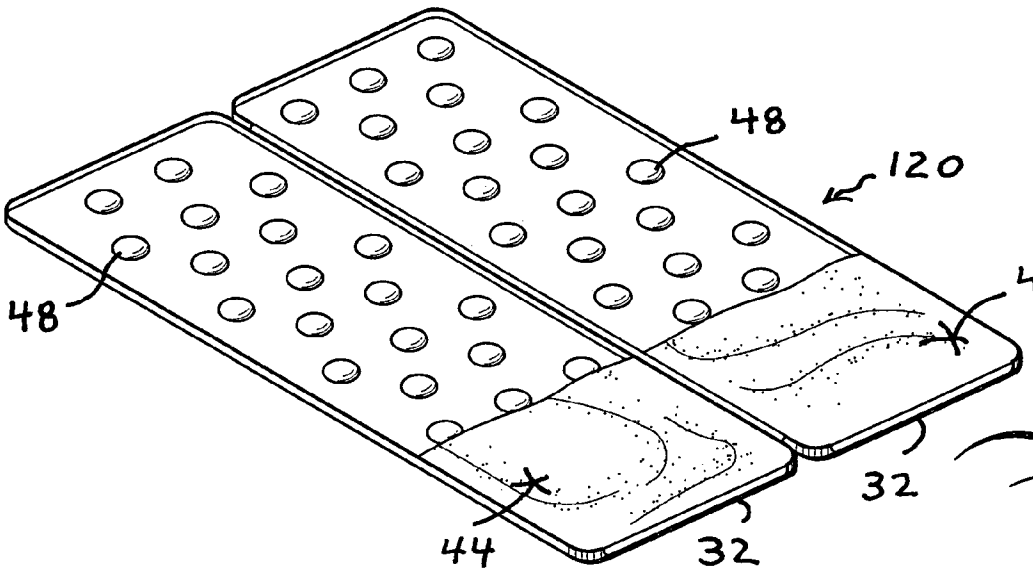
FIG. 8 is a perspective view comparable to FIG. 3 except showing an alternate embodiment of the invention wherein the color base and activator chemicals are pre-charged in only a fraction of the compact in order to work on just the roots of customer's hair which have grown out since her or his last visit to her or his beautician.

FIG. 8 is a perspective view comparable to FIG. 3 except showing an alternate embodiment of a compact 120 in accordance with the invention wherein the color base and activator chemicals 44 are pre-charged in only a fraction of this compact 120 in order to work on just the roots of customer's hair which have grown out since her or his last visit to her or his beautician.

More particularly, FIG. 8 shows the plastic compact 120 open, exposing the two compartments 24, one partially charged with the color base and the other partially charged with the activator. Both compartments 24 have a series of protrusions 48 that assist in mixing the two chemicals 44 together when the compact 120 is shut. The protrusions 48 do not actually come into contact with each other but they do promote pushing the chemical 44 in their half of the compact 120 to mix with the chemical 44 on the other half. This particular compact 120 only has the activator and color base about a quarter of the way down from the scalp-ward edges 32 of the compact 120. This compact 120 is advantageous to do hair treatments in which only the roots need to be highlighted (or otherwise treated). For example, a customer comes in with brown hair and wants blond highlights and gets these throughout her hair. In a few months, as her (or his) hair grows, the new hair portions will be brown since those have not been highlighted. It is considered unattractive to have brown roots showing under blond portions of highlighted hair. A root touch-up is needed instead of a full highlight (or treatment) since not all of the hair needs coloring. It is damaging to hair to be highlighted (or treated) more than necessary or more times than once on the same portions due to the strength of the chemicals needed to color base hair.

Figure 9:
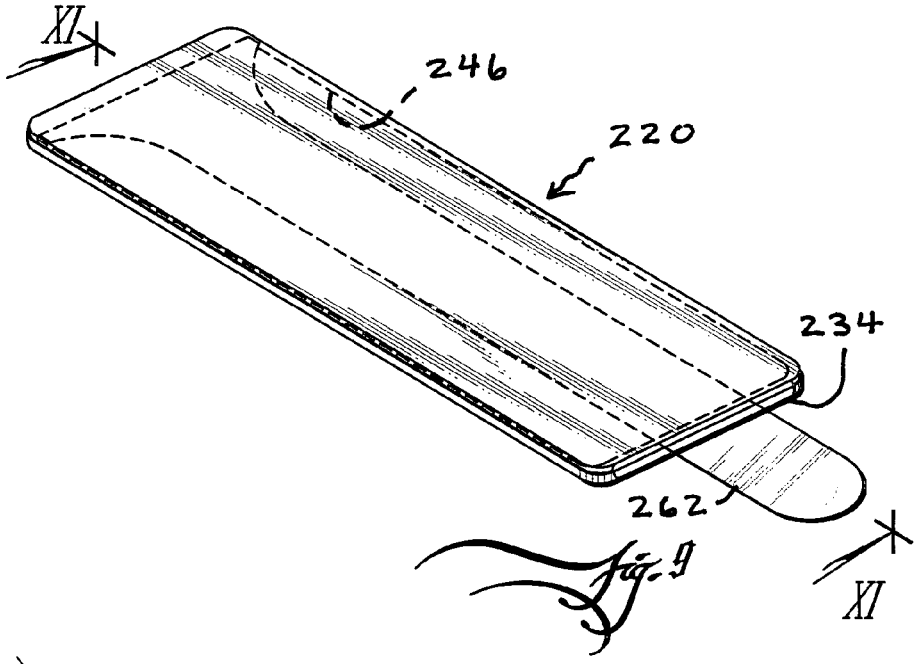
FIG. 9 is a perspective view comparable to FIG. 4 except showing peel-away covering films which are adapted to be stripped out the tail end of the closed compact by means of a pair of pull tabs.
Figure 10:
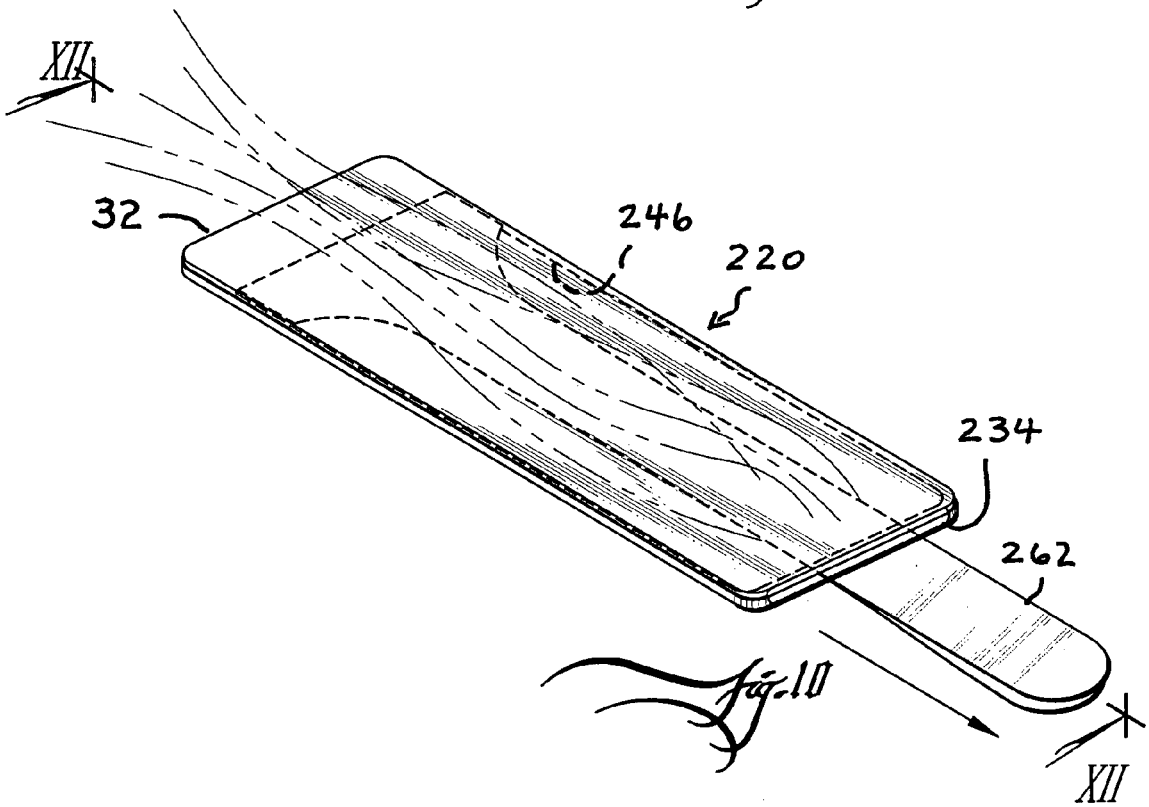
FIG. 10 is a perspective view comparable to FIG. 9 except showing the film-stripping process in progress.

FIGS. 9 and 10 show an alternate embodiment of a compact 220 in accordance with the invention. In FIGS. 9 and 10, the peel-away covering films 246 are adapted to be stripped out the tail edges 234 of the closed compact 220 by means of a pair of pull tabs 262. To contrast with FIGS. 2 and 3, in those views the peel-away covering film 46 is removed while the compact 20 is open, and before being snapped shut on a bundle of customers hair. However, here in FIGS. 9 and 10 the peel-away covering films 246 that are used to separate the activator from the color base are kept attached to the compact 220 until the compact 220 is snapped shut onto the selected bundle of the customer's hair. Then the peel-away covering films 246 are stripped out together with one vigorous pull on the pull tabs 262 that extend outside of the tail edges 234 of the shut plastic compact 220. Stripping out the peel-away covering films 246 allows, needless to say, the color base and activator to mix and thereby work their treatment on the hair.

The advantages provided by the FIGS. 9 and 10 embodiment of a compact 220 in accordance with the invention include the following. That is, the beautician can undertake a project which involves placing dozens or even hundreds of the inventive compacts 220 on a customers hair. The earliest placed compacts 220 might be in place an hour or more before the later placed compacts 220. Accordingly, if the compacts 220 are all placed and snapped shut with the peel-away covering films 246 removed, then in consequence the treatment of the bundles of hair in the earliest-placed compacts 220 will take place for an hour or more longer than the later-placed compacts 220. In other words, there is an uneven start time for all the bundles of hair. Some will have been treated for an hour or more before the last compacts 220 are put in place during a given project.

However, the FIGS. 9 and 10 embodiment of a compact 220 in accordance with the invention affords the following convenience for the beautician and customer. That is, the beautician can work steadily to put all the compacts 220 in place: —and yet not peel off any of the peel-away covering films 246. That way, the compacts 220 are set in place but nevertheless the chemicals 44 remain separated from each, hence there is no pre-mature reaction or treatment of hair going on. Then, when the beautician is ready to activate all the compacts 220 with a short time span of each other, the beautician can revisit all the placed and snapped-shut compacts 220 and peel out all the peel-away covering films 246 serially, one by one. In consequence, the treatment time for each compact 220 should begin more nearly at the same time with each other than otherwise achievable.

Figure 11:
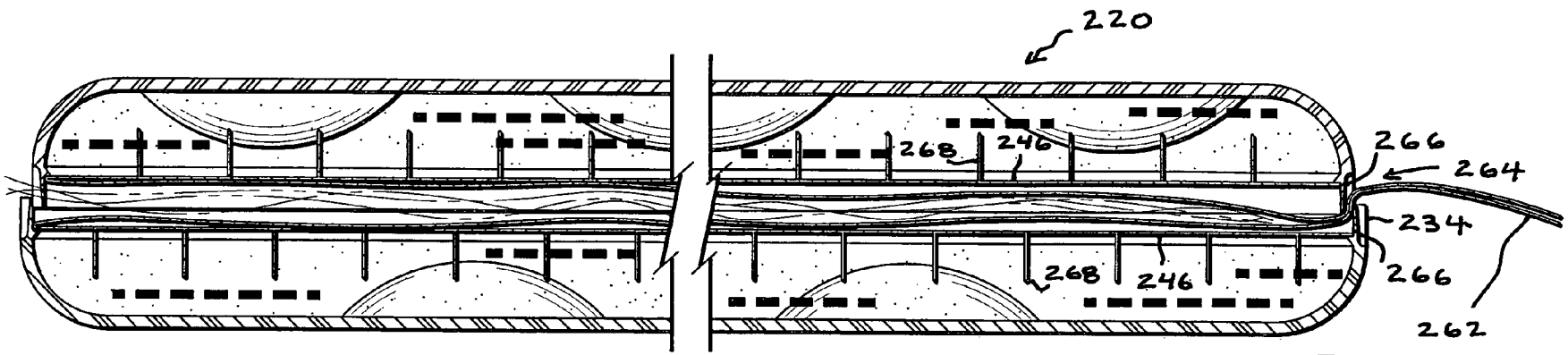
FIG. 11 is an enlarged scale sectional view taken along the line of XI-XI in FIG. 9, with central portions broken away.
Figure 12:
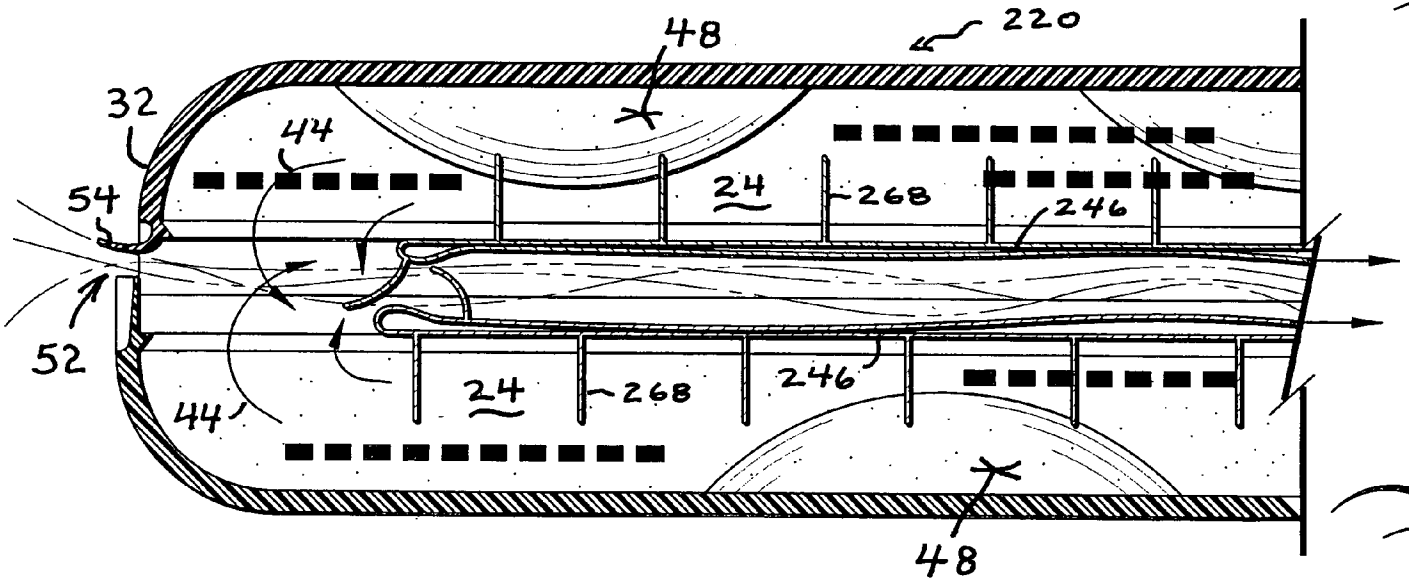
FIG. 12 is an enlarged scale sectional view taken along the line of XII-XII in FIG. 9, with portions to the right thereof broken away.

FIGS. 11 and 12 show further advantages of the FIGS. 9 and 10 embodiment of a compact 220 in accordance with the invention. As FIG. 11 shows, and aside from the scalp-ward edges 32, the inventive compact 220 has a slot 264 protected by wiper-formations 266 at the tail edges 234 too. The wiper-formations 266 at the tail-edges 234 of the compact 220 allow for the withdrawal and removal of the peel-away covering films 246.

Also, the peel-away covering films 246 are provided with an axially-distributed series of transverse paddles 268 (or ribs or flights). The paddles 268 originally extend into the compartment 24 with which the peel-away covering film 246 is associated. That is, the paddles 268 are embedded in the chemical 44 of their own compartment 24. As FIG. 12 shows better, during the process of withdrawing the peel-away covering films 246, the paddles 268 are forced to sweep through a half of a rotation, ultimately sweeping part way into the opposite compartment 24. As FIG. 12 shows, when these paddles 268 sweep into the opposite compartment 24 they push a little bit of the chemical 44 in their own compartment 24 into the opposite compartment 24, and this better promotes mixing between two chemicals 44 (which before the peel-away covering films 246 were withdrawn were maintained sealed and separated from each other). The paddles 268 are staggered so as to further coordinate their work at promoting mixing of the two chemicals 44.

FIGS. 11 and 12 shows that the plastic compact 220 is snapped-shut on a bundle of hair. FIG. 12 shows that the paddle-formed (or ribbed or flighted) peel-away covering films 246 are readily withdrawn out the tail of the compact 220 with the hair bundle in place.

Figure 13:
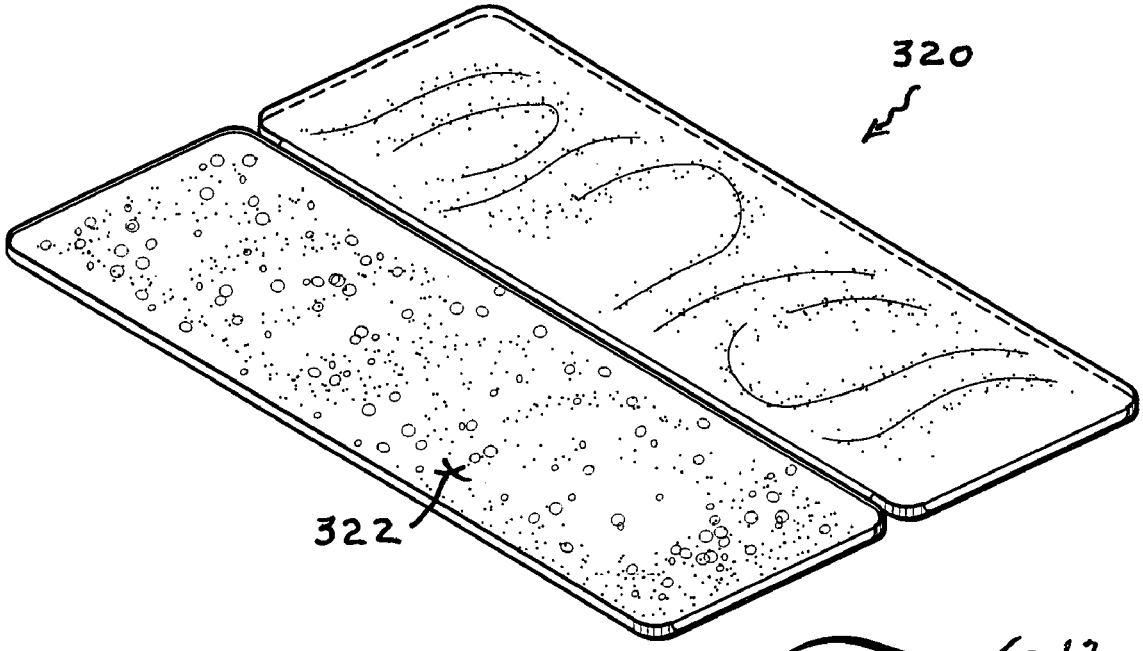
FIG. 13 is a perspective view comparable to FIG. 3 except showing another embodiment of the invention.

FIG. 13 shows a further embodiment of a pre-charged folded compact 320 in accordance with the invention. FIG. 13 is comparable to FIG. 3 in that peel-away covering films 46 have been peeled off both compartments 24 of the folding compact 320. FIG. 13 is distinguished from FIG. 3 in that one compartment 24 (eg., the lower compartment 24 in the view of FIG. 13) of the compact 320 is provided with a sponge liner 322 in order to help retain a liquid chemical 44 (in contrast to paste or gel and the like). That is, some forms of activator chemicals 44 in particular would readily spill out of the compartment 24 after the peel-away covering film 46 (not shown in FIG. 13) is removed unless some measures are taken to keep such a spillable chemical 44 retained therein, such as the sponge liner 322 as shown.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An applicator for transferring hair-coloring chemicals to a selected bundle of hair; comprising:

a case having a pair of opposing shallow compartments;

each compartment comprising a web extending laterally between a connecting edge and a spaced closure edge as well as axially between a scalp-ward edge and a spaced tail edge;

each compartment further comprising complete or incomplete low peripheral rims extending along the edges of said web thereof;

a connector for connecting the one rim and the other rim of the opposed compartments that extend along the respective connecting edges thereof;

a closure for releasably closing the one rim and the other rim of the of the opposed compartments that extend along the respective closure edges thereof, whereby said case can be releasably shut closed with said opposing shallow compartments in opposition to each other;

a pre-charge of color-base hair-coloring chemicals in one compartment and a pre-charge of activator therefor in the other compartment; and readily-removable barriers sealingly-covering each compartment in order to seal in the respective pre-charges therein not only to keep the respective pre-charges separate and apart from each other and avoid pre-mature interaction therebetween but also to keep each pre-charge fresh and preserved until some temporally-remote time later when mixed with the other after the sealingly-covering barriers are removed and the case is closed shut;

wherein each compartment of said case includes a series of protrusions that promote pushing the pre-charge therein to mix with the pre-charge in the opposing compartment after the respective sealingly-covering barriers therefor are removed and the case is closed shut.

2. An applicator for transferring hair-coloring chemicals to a selected bundle of hair; comprising:

a case having a pair of opposing shallow compartments;

each compartment comprising a web extending laterally between a connecting edge and a spaced closure edge as well as axially between a scalp-ward edge and a spaced tail edge;

each compartment further comprising complete or incomplete low peripheral rims extending along the edges of said web thereof;

a connector for connecting the one rim and the other rim of the opposed compartments that extend along the respective connecting edges thereof;

a closure for releasably closing the one rim and the other rim of the of the opposed compartments that extend along the respective closure edges thereof, whereby said case can be releasably shut closed with said opposing shallow compartments in opposition to each other;

a pre-charge of color-base hair-coloring chemicals in one compartment and a pre-charge of activator therefor in the other compartment; and readily-removable barriers sealingly-covering each compartment in order to seal in the respective pre-charges therein not only to keep the respective pre-charges separate and apart from each other and avoid pre-mature interaction therebetween but also to keep each pre-charge fresh and preserved until some temporally-remote time later when mixed with the other after the sealingly-covering barriers are removed and the case is closed shut;

wherein one or both the low peripheral rims along one or both the scalp-ward edges of the opposing compartments form a slot such that, after the respective sealingly-covering barriers therefor are removed and the case is closed shut, a bundle of hair that is being color-treated and closed shut in the case is allowed to extend out said slot;

further comprising one or more wiper-formations associated said slot serving as resilient seals not only to contain the mixing pre-charges after the respective sealingly-covering barriers therefor are removed and the case is closed shut during the extended time that is given to the pre-charges to color-treat or interact with the encased bundle of hair but also to eliminate or minimize the likelihood that mixing pre-charges will leak and thereafter undesirably interact with or treat hair strands that are not selected by the beautician for the bundle.

3. An applicator for transferring hair-coloring chemicals to a selected bundle of hair; comprising:

a case having a pair of opposing shallow compartments;

each compartment comprising a web extending laterally between a connecting edge and a spaced closure edge as well as axially between a scalp-ward edge and a spaced tail edge;

each compartment further comprising complete or incomplete low peripheral rims extending along the edges of said web thereof;

a connector for connecting the one rim and the other rim of the opposed compartments that extend along the respective connecting edges thereof;

a closure for releasably closing the one rim and the other rim of the of the opposed compartments that extend along the respective closure edges thereof, whereby said case can be releasably shut closed with said opposing shallow compartments in opposition to each other;

a pre-charge of color-base hair-coloring chemicals in one compartment and a pre-charge of activator therefor in the other compartment; and readily-removable barriers sealingly-covering each compartment in order to seal in the respective pre-charges therein not only to keep the respective pre-charges separate and apart from each other and avoid pre-mature interaction therebetween but also to keep each pre-charge fresh and preserved until some temporally-remote time later when mixed with the other after the sealingly-covering barriers are removed and the case is closed shut;

wherein said readily-removable barriers comprises peel-away covering films; and wherein said peel-away covering films include pull tabs projecting out the one and another rims that extend along the tail edges of the opposed compartments whereby said peel-away covering films afford a beautician opportunity to strip the films out between shut tail edges after the case has been closed shut on a selected bundle of hair by virtue of the pull tabs, whereby the case can be closed shut on the selected bundle hair first and then, second, the opposed compartments can be unsealed rather than vice versa.

4. The applicator of claim 3 wherein said tabs of the peel-away covering films are arranged to extend axially to scalp-ward extremes of the peel-away covering films and strip such back to tail-ward extremes thereof in a progressive roll.

5. The applicator of claim 4 wherein said peel-away covering films are provided with an axially-distributed series of ribs or flights which originally extend into the respective sealed compartment whereby, during the process of stripping out the peel-away covering films, the ribs or flights sweep through a half of a rotation, ultimately part way into the progressively-opening opposite compartment, thereby pushing some pre-charge of the original compartment into the opposite compartment and thereby better promoting mixing between the respective pre-charges.

6. The applicator of claim 1 wherein said opposed compartments comprise relatively symmetric rectangular compartments.

7. The applicator of claim 3 wherein said connector comprises a thin ribbon of connecting material that spans between said one and another rims of the opposed compartments that extend along the respective connecting edges thereof, whereby said thin ribbon of material forms a hinge joint for said case.

8. The applicator of claim 7 wherein said case and thin ribbon of connecting material are produced as a monolithic piece of plastic material.

9. The applicator of claim 7 wherein said closure for releasably closing said one and another rims of the of the opposed compartments that extend along the respective closure edges thereof comprises counterpart barb and catch formations so that the case snaps shut and stays relatively locked upon closure.

10. A method of color-treating hair comprising the steps of:

providing a folding case having a pair of shallow opposing compartments, one pre-charged with color-base hair-coloring chemicals, the other with activator therefor, and each sealingly-covered with a readily-removable barriers in order to seal in the respective pre-charges therein not only to keep the respective pre-charges separate and apart from each other and avoid pre-mature interaction therebetween but also to keep each pre-charge fresh and preserved until some temporally-remote time later when mixed with the other after the sealingly-covering barriers are removed and the case is closed shut on a selected bundle of hair;

selecting a bundle of hair for color treatment; and then using the said case for color-treating said selected bundle of hair by either shutting the case closed thereon then removing the barriers or else removing the barriers then shutting the case closed thereon;

wherein said case further comprises a releasable closure formation for releasably retaining the case in a shut closed position; and wherein the step of shutting the case closed takes place before the step of removing the barriers.

11. The method of claim 10 wherein the barriers comprises peel-away films that extend axially in the case between spaced-apart scalp-ward and tail-ward extremes, said step of removing the barriers further comprises stripping-out the peel-away films from the tail-ward extremes thereof.

* * * * *